US011566355B1

(12) United States Patent
Chen

(10) Patent No.: US 11,566,355 B1
(45) **Date of Patent: *Jan. 31, 2023**

(54) BRAIDING APPARATUS CAPABLE OF GENERATING A TWO-POINT INTERWEAVING OPERATION

(71) Applicant: Ming-Cheng Chen, Taichung (TW)

(72) Inventor: Ming-Cheng Chen, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/368,070

(22) Filed: Jul. 6, 2021

(51) Int. Cl.

| | |
|---|---|
| ***D04C 3/24*** | (2006.01) |
| ***D04C 3/06*** | (2006.01) |
| ***D04C 3/48*** | (2006.01) |
| ***D04C 3/12*** | (2006.01) |
| ***D04C 3/38*** | (2006.01) |

(52) U.S. Cl.
CPC ..... *D04C 3/24* (2013.01); *D04C 3/06* (2013.01); *D04C 3/12* (2013.01); *D04C 3/38* (2013.01); *D04C 3/48* (2013.01)

(58) Field of Classification Search
CPC ... D04C 3/06; D04C 3/12; D04C 3/24; D04C 3/30; D04C 3/38; D04C 3/48
See application file for complete search history.

(56) References Cited

U.S. PATENT DOCUMENTS 856,985 A * 6/1907 Rahm ..... D04C 3/30 87/37
894,022 A * 7/1908 Lepperhoff ..... D04C 3/00 87/37
933,341 A * 9/1909 Rahm ..... D04C 1/06 87/37
1,885,676 A * 11/1932 Blaisdell ..... D04C 1/00 87/50
1,891,211 A * 12/1932 Blaisdell ..... D04C 3/20 87/6
2,018,596 A * 10/1935 Blaisdell ..... D04C 3/16 87/23
2,879,687 A * 3/1959 Leimbach ..... D04C 3/06 87/37

(Continued)

FOREIGN PATENT DOCUMENTS

DE 102009017312 A1 * 10/2010 ..... D04C 3/24
DE 102016010176 A1 * 2/2018 ..... D04C 3/48

(Continued)

*Primary Examiner* — Shaun R Hurley
(74) *Attorney, Agent, or Firm* — Rosenberg, Klein & Lee

(57) ABSTRACT

A braiding apparatus includes a platform, a base plate, a core unit, a transmission unit, a track assembly, and strand carriers. The track assembly is divided into two braiding track groups each provided with transmission discs. The transmission discs of both braiding track groups are sequentially connected to define two braiding routes. The strand carriers shuttle on both braiding routes respectively and incessantly. Two intersection points are defined when the two braiding routes intersect. Accordingly, carrier strands fed by the strand carriers are wound around a core strand fed by the core unit while shuttling incessantly and are interwoven with each other while passing through the two intersection points during the incessant shuttling motion, thereby wrapping a multi-convolutional braided layer around the core strand to complete a rope. Each convolution of the braided layer has two crossing points, which increases the practicability of the rope.

2 Claims, 7 Drawing Sheets

(56) References Cited

U.S. PATENT DOCUMENTS

| | | | | |
|---|---|---|---|---|
| 3,866,512 | A * | 2/1975 | Berger | D04C 3/30 87/8 |
| 5,287,790 | A * | 2/1994 | Akiyama | D04C 3/48 87/9 |
| 5,385,077 | A * | 1/1995 | Akiyama | B29C 70/24 87/8 |
| 5,396,829 | A | 3/1995 | Akiyama et al. | |
| 9,845,572 | B2 * | 12/2017 | Kirth | D04C 3/40 |
| 10,060,056 | B1 * | 8/2018 | Head | D04C 3/08 |
| 2004/0094024 | A1 * | 5/2004 | Kim | D04C 3/12 87/9 |
| 2009/0188380 | A1 | 7/2009 | Dow et al. | |
| 2015/0040746 | A1 * | 2/2015 | Kirth | D04C 1/06 87/8 |
| 2015/0059563 | A1 * | 3/2015 | Kirth | D04C 3/48 87/6 |
| 2016/0183942 | A1 * | 6/2016 | Allen | D04C 3/40 606/228 |

FOREIGN PATENT DOCUMENTS

| | | | |
|---|---|---|---|
| EP | 2251472 | B1 | 4/2010 |
| WO | 2012090925 | A1 | 7/2012 |

* cited by examiner

BRAIDING APPARATUS CAPABLE OF GENERATING A TWO-POINT INTERWEAVING OPERATION

BACKGROUND OF THE INVENTION

1. Field of the Invention

This invention relates to a braiding apparatus and relates particularly to a braiding apparatus having a track assembly capable of executing a two-point interweaving operation.

2. Description of the Related Art

Referring to FIG. 1 through FIG. 3, a conventional braiding apparatus 1, as briefly shown, includes a platform 11, a base plate 12 disposed on the platform 11, a core unit 13 centered on the base plate 12 for feeding a core strand "a", a transmission unit 14 disposed below the base plate 12, a track unit 15 arranged on the base plate 12, and a plurality of strand carriers 16 shuttling on the track unit 15 for feeding carrier strands "c". The track unit 15 includes a plurality of rotating discs 151 arranged around the core unit 13 and connected one after another to assume a circular arrangement. Each rotating disc 151 includes a plurality of notches 152 for carrying the strand carriers 16. An intersection 153 is formed between any two adjacent rotating discs 151 under the circular arrangement of the track unit 15, which thereby defines an internal route "b1" and an external route "b2".

When the transmission unit 14 is actuated, the strand carriers 16 move under a guiding motion of the track unit 15. In other words, the rotating discs 151 cooperate with the notches 152 to convey the strand carriers 16 so that the strand carriers 16 travels between the rotating discs 151 through the intersections 153 for shuttling on the internal route "b1" and the external route "b2" continuously. Meanwhile, each carrier strand "c" fed by each strand carrier 16 is incessantly pulled in different directions under the continuous shutting motion of the strand carriers 16. Therefore, the carrier strands "c" are crowdedly interwoven with each other to execute a crowded braiding operation whereby a braided layer is formed. The braided layer is provided with multiple convolutions and wrapped around the core strand "a", thereby producing a complete rope 2 shown in FIG. 3. During the crowded braiding operation, each convolution of the braided layer forms multiple crossing points 21 close to each other when the carrier strands "c" and other carrier strands "c" cross each other, as illustrated in FIG. 2 in which only the front view of the braided layer is shown.

Because the intersections 153 are formed based on the circular arrangement, the braided layer formed by interweaving the carrier strands "c" shows a crowdedly-interwoven pattern wound around the core strand "a". However, the application of this crowded pattern is still limited. For example, too many crossing points 21 are formed because of the above interweaving mode, with the result that too many interstices are left between the carrier strands "c" and the core strand "a", and the contact surface between the carrier strands "c" and the core strand "a" is also reduced. These conditions affect the heat conduction and limit the efficiency of dissipating heat while using the rope 2 in terms of heat dissipation. Thus, the conventional crowdedly-interwoven pattern formed by the crowded braiding operation is difficult to meet practical demand and still needs to be improved.

SUMMARY OF THE INVENTION

An object of this invention is to provide a braiding apparatus capable of generating a two-point interweaving operation, a track assembly of which defines a first braiding route and a second braiding route meeting at two intersections whereby a complete rope with a braided layer different from the conventional crowded pattern is produced, especially each convolution of the braided layer provides two crossing points to increase the practicability of the rope.

The braiding apparatus of this invention includes a platform, a base plate disposed on the platform, a core unit adapted to supply a core strand, a transmission unit disposed below the base plate, a track assembly arranged on the base plate, and a plurality of strand carrier shuttling on the track assembly and adapted to supply carrier strands. The track assembly includes a plurality of transmission discs disposed on the base plate and driven by the transmission unit. Each transmission disc has a plurality of notches formed thereon and adapted to carry the strand carriers. The transmission discs are connected to each other to thereby divide the track assembly into a first braiding track group and a second braiding track group. Both of the first braiding track group and the second braiding track group are arranged around the core unit when the core unit is centered on the base plate, and the first braiding track group is encircled by the second braiding track group. The transmission discs of the first braiding track group and the transmission discs of the second braiding track group are sequentially connected to each other, thereby defining a first braiding route and a second braiding route which meet to form two intersections. The two intersections are spaced at 180 degrees from each other. The transmission discs on the first braiding route and the transmission discs on the second braiding route are rotated in different directions, namely in opposite directions. According to the above, the strand carriers are allowed to shuttle on the first braiding route and the second braiding route respectively and incessantly to execute an incessant shuttling motion whereby the core strand is wrapped in the carrier strands fed by the strand carriers. During the incessant shuttling motion, the carrier strands are interwoven with each other on an outer surface of the core strand when the strand carriers travel through the two intersections. Therefore, a full braided layer with multiple convolutions is created and wrapped around the core strand to thereby complete a braided rope, especially each of the convolutions has two crossing points to provide the rope with a special braided arrangement different from the conventional crowdedly-interwoven pattern. This special braided arrangement can promote the practicability of the rope.

Preferably, in one preferred embodiment, the first braiding route and the second braiding route intersect to form the two intersections, thereby assuming a state of double interlinking circuits.

DETAILED DESCRIPTION OF THE PREFERRED EMBODIMENTS

Figure 4:
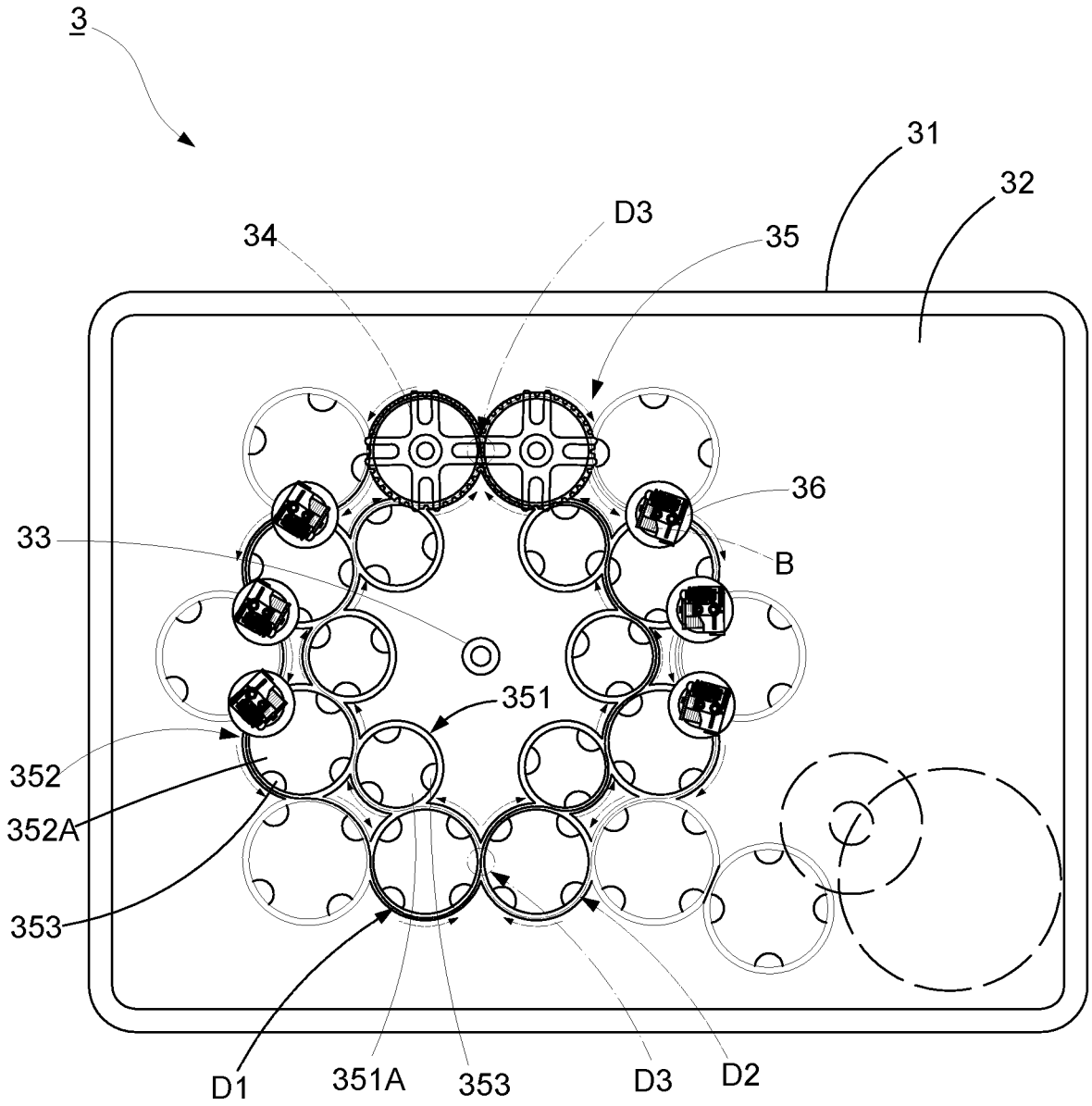
FIG. 4 is a schematic view showing a first preferred embodiment of this invention.
Figure 9:
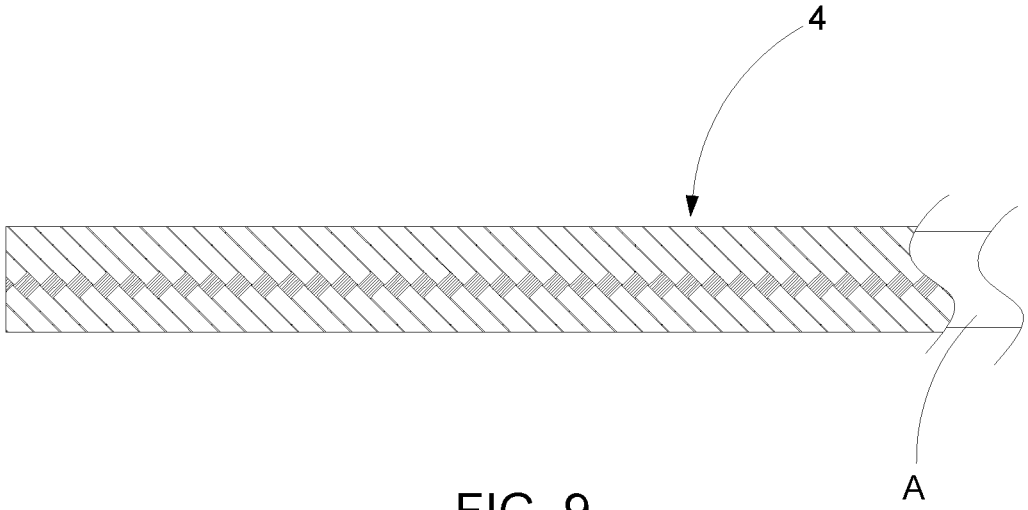
FIG. 9 is a front view of a complete braided rope produced by the first preferred embodiment.

Referring to FIG. 4, a first preferred embodiment of a braiding apparatus capable of generating a two-point interweaving operation is briefly shown. The braiding apparatus 3 includes a platform 31, a base plate 32 disposed on the platform 31, a core unit 33 disposed on the base plate 32 and configured to supply a core strand "A", a transmission unit 34 disposed below the base plate 32, a track assembly 35 arranged on the base plate 32, and a plurality of strand carriers 36 movably mounted on the track assembly 35 and adapted to shuttle on the track assembly 35. The strand carriers 36, as briefly shown, have carrier strands "B" wound thereon respectively, and the carrier strands "B" are fed by the strand carriers 36 so that an outer surface of the core strand "A" fed by the core unit 33 can be wrapped in the carrier strands "B", as shown in FIG. 9.

The track assembly 35 is arranged around the core unit 33 by taking the core unit 33 as a center. Specifically, the track assembly 35 includes a plurality of transmission discs 351A, 352A disposed on the base plate 32 and arranged around the core unit 33 when the core unit 33 is centered on the base plate 32. The transmission discs 351A, 352A are driven by the transmission unit 34. Each of the transmission discs 351A, 352A has a plurality of notches 353 formed thereon for receiving and carrying the strand carriers 36. Accordingly, when the strand carriers 36 embedded into the notches 353 experience rotations of the transmission discs 351A, 352A, the strand carriers 36 are smoothly transported to shuttle on the track assembly 35 continuously, which thereby executes an incessant shuttling motion.

The transmission discs 351A, 352A of the track assembly 35 are connected to each other, which allows the transmission discs 351A, 352 to be grouped. In other words, the track assembly 35 is divided into a first braiding track group 351 and a second braiding track group 352, so the transmission discs 351A belong to the first braiding track group 351, and the transmission discs 352A belong to the second braiding track group 352. When the core unit 33 is centered on the base plate 32, both of the first braiding track group 351 and the second braiding track group 352 surround the core unit 33 by taking the core unit 33 as the center. The first braiding track group 351 is encircled or surrounded by the second braiding track group 352, so the transmission discs 352A of the second braiding track group 352 surround the transmission discs 351A of the first braiding track group 351.

Furthermore, the rotations of the transmission discs 351A of the first braiding track group 351 are actuated by the transmission unit 34. The transmission discs 351A are, but not limited to, sequentially connected to each other, spaced from each other, or partially connected to each other. In the drawings, it is taken as an example that the first braiding track group 351 has six transmission discs 351A which are spaced from each other. The rotations of the transmission discs 352A of the second braiding track group 352 are actuated by the transmission unit 34. The transmission discs 352A are, but not limited to, sequentially connected to each other, spaced from each other, or partially connected to each other. In the drawings, it is taken as an example that the second braiding track group 352 has fourteen transmission discs 352A which are sequentially connected, namely connected one after another. The arrangement and the number of the transmission discs 351A, 352A can be adjusted to meet need.

Figure 5:
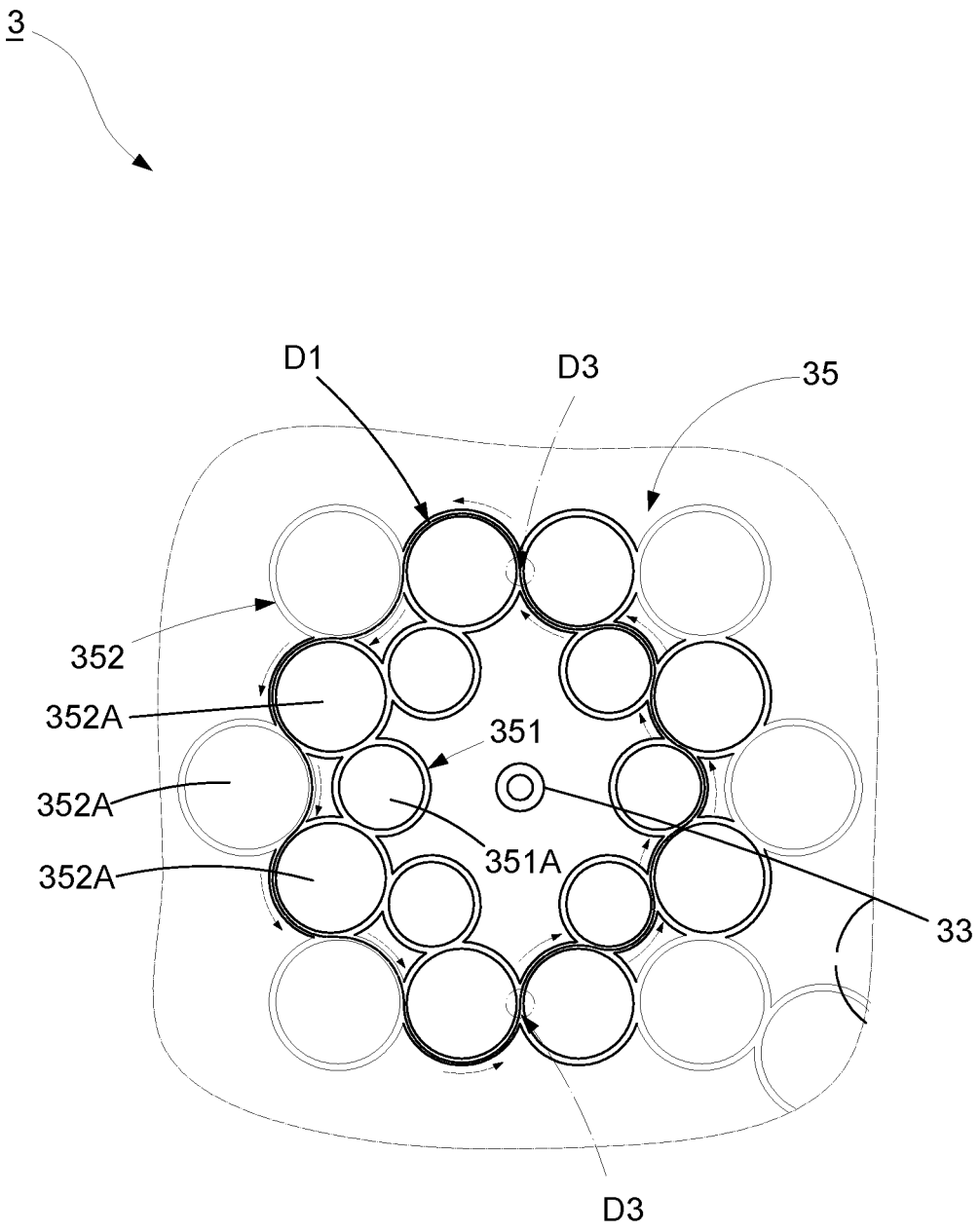
FIG. 5 is a schematic view of a first braiding route of the first preferred embodiment.
Figure 6:
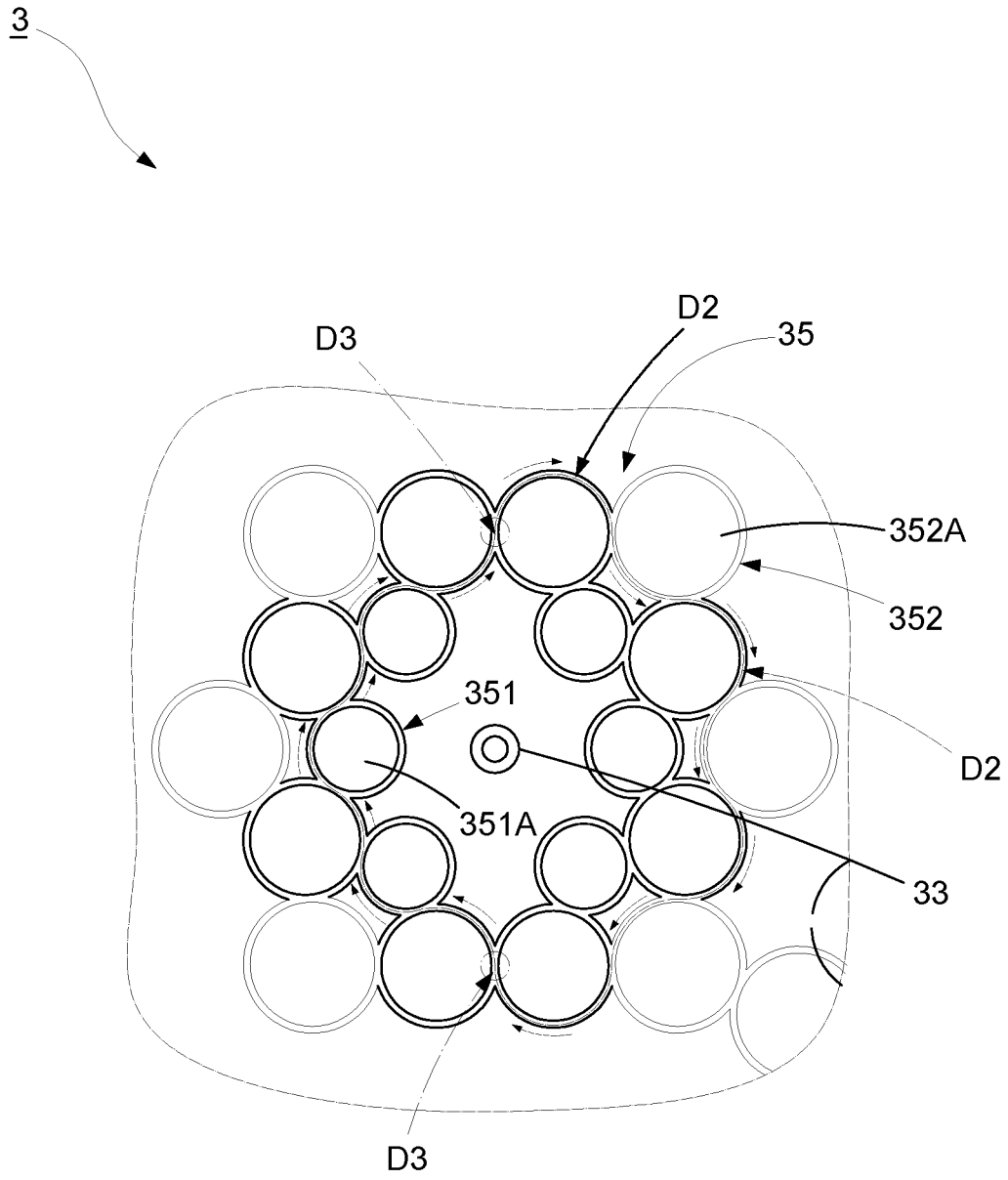
FIG. 6 is a schematic view of a second braiding route of the first preferred embodiment.

The transmission discs 351A, 352A of the first braiding track group 351 and the second braiding track group 352 are sequentially connected to each other to thereby define different braiding routes D1, D2. For example, two sides of one transmission disc 351A are respectively connected to two transmission discs 352A which are adjacent to this transmission disc 351A, and other transmission discs 351A are also adapted to the same connecting mode. Meanwhile, the transmission discs 352A are connected in sequence. The above shows an alternate connection, so a first braiding route D1 (shown in FIG. 5) and a second braiding route D2 (shown in FIG. 6) can be defined on the whole track assembly 35, thereby allowing a group of strand carriers 36 to shuttle on the first braiding route D1 continuously and simultaneously allowing another group of strand carriers 36 to shuttle on the second braiding route D2 continuously. Thus, the incessant shuttling motion on both of the first braiding route D1 and the second braiding route D2 is executed.

Figure 7:
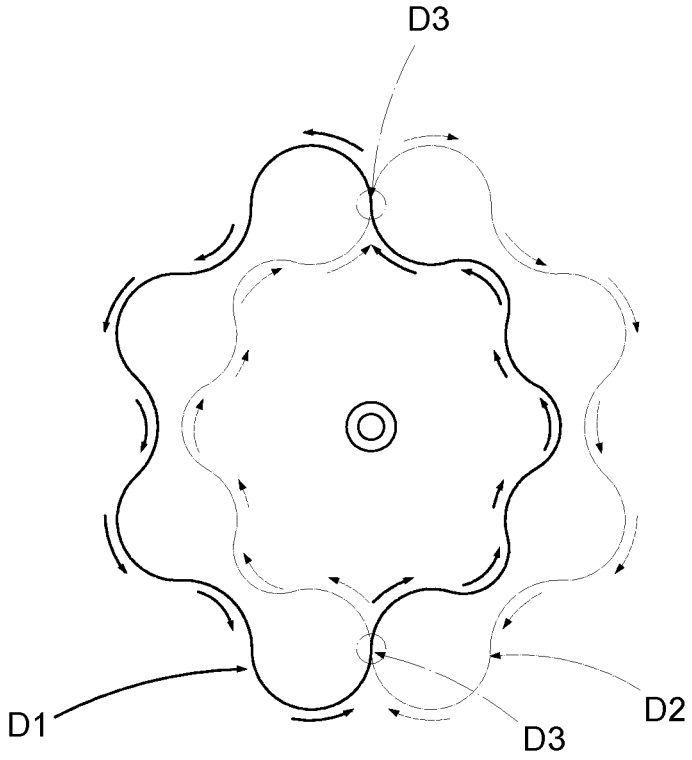
FIG. 7 is a brief view of the first preferred embodiment showing both of the first braiding route and the second braiding route which allow strand carriers to shuttle thereon.

The first braiding route D1 and the second braiding route D2 intersect or meet each other. Preferably, it is assumed that the first braiding route D1 is defined as a circuit having a first circuitous style while the second braiding route D2 is defined as another circuit having a second circuitous style, and the two circuits not only sit next to each other but also cross partially to assume a chain-like interlinking state, namely double intersecting circuits as shown in FIG. 7 in which the bold or thick line represents the first braiding route D1, and the thin line represents the second braiding route D2. Thus, when the first braiding route D1 and the second braiding route D2 intersect to show the chain-like connection, two intersection points D3, also referred to herein intermittently, for simplicity, as "intersections" (for plural) or an "intersection" (for singular), circled parts shown in FIGS. 4 and 7, are formed, and the two intersections D3 are located in opposite directions to be spaced at 180 degrees from each other. In other words, if a reference line from one intersection D3 to the core unit 33 is defined, and the other reference line from the other intersection D3 to the core unit 33 is also defined, the two references lines are in a line so that the two intersections D3 are spaced from each other by 180 degrees. In addition, the direction of rotating the transmission discs 351A on the first braiding route D1 is different from the direction of rotating the transmission discs 352A on the second braiding route D2, as arrowed in FIG. 7. Accordingly, during the shutting motion of the strand carriers 36 on both braiding routes D1, D2, the carrier strands "B" fed by the strand carriers 36 cross to be interwoven with each other when the strand carriers 36 pass through each intersection D3. The interweaving operation of the carrier strands "B" occur in the two intersections D3, with the result that around the core strand "A" is wrapped a braided layer, each convolution of which only has two crossing points 41.

The operation of this invention is described with the aid of FIG. 4 and FIG. 7. Firstly, a start end of a core strand "A" of the core unit 33 is fed to a strand collector (not shown), and a start end of a carrier strand "B" of each strand carrier 36 is also fed to the strand collector. Then, the braiding device 3 transmits power to operate the transmission unit 34, and the rotations of the transmission discs 351A, 352A are concurrently actuated when the transmission unit 34 is in action. During the rotations of the transmission discs 351A, 352A, the strand carriers 36 shuttle on the first braiding route D1 and the second braiding route D2, and each carrier strand "B" subjects an outer surface of the core strand "A" to winding and interweaving so that the core strand "A" is wrapped in the carrier strands "B". As for example arrowed in FIGS. 4 and 7, a group of strand carriers 36 located on the first braiding route D1 can only shuttle on the route D1 incessantly, and another group of strand carriers 36 located on the second braiding route D2 can only shuttle on the route D2 incessantly. Accordingly, the carrier strands "B" are continuously wound around the outer surface of the core strand "A" because of different shuttling directions of the strand carriers 36 on both routes D1, D2. Meanwhile, when the strand carriers 36 travel through the two intersections D3 in sequence during the aforementioned shutting motion, the carrier strands "B" cross to be interwoven with each other on the outer surface of the core strand "A". Thus, the shuttling motion of the strand carriers 36 causes a winding and interweaving operation, and the winding and interweaving operation between the carrier strands "B" and the core strand "A" is continuous to provide an incessant braiding action whereby a rope 4 is finally produced. The rope 4 is then collected by the strand collector for further use. In FIG. 9, it shows that the complete rope 4 has a braided layer created by the winding and interweaving operation and provided with multiple convolutions or coils which are wound around the core strand "A", and each convolution or each coil of the braided layer has two crossing points 41. The two crossing points 41 are spaced from each other when each convolution is made, as illustrated in FIG. 8 where the front view of the braided layer shows one crossing point 41 by a solid line, and the other circled part shown as a dotted line represents the other crossing point 41 formed on the back.

Figure 1:
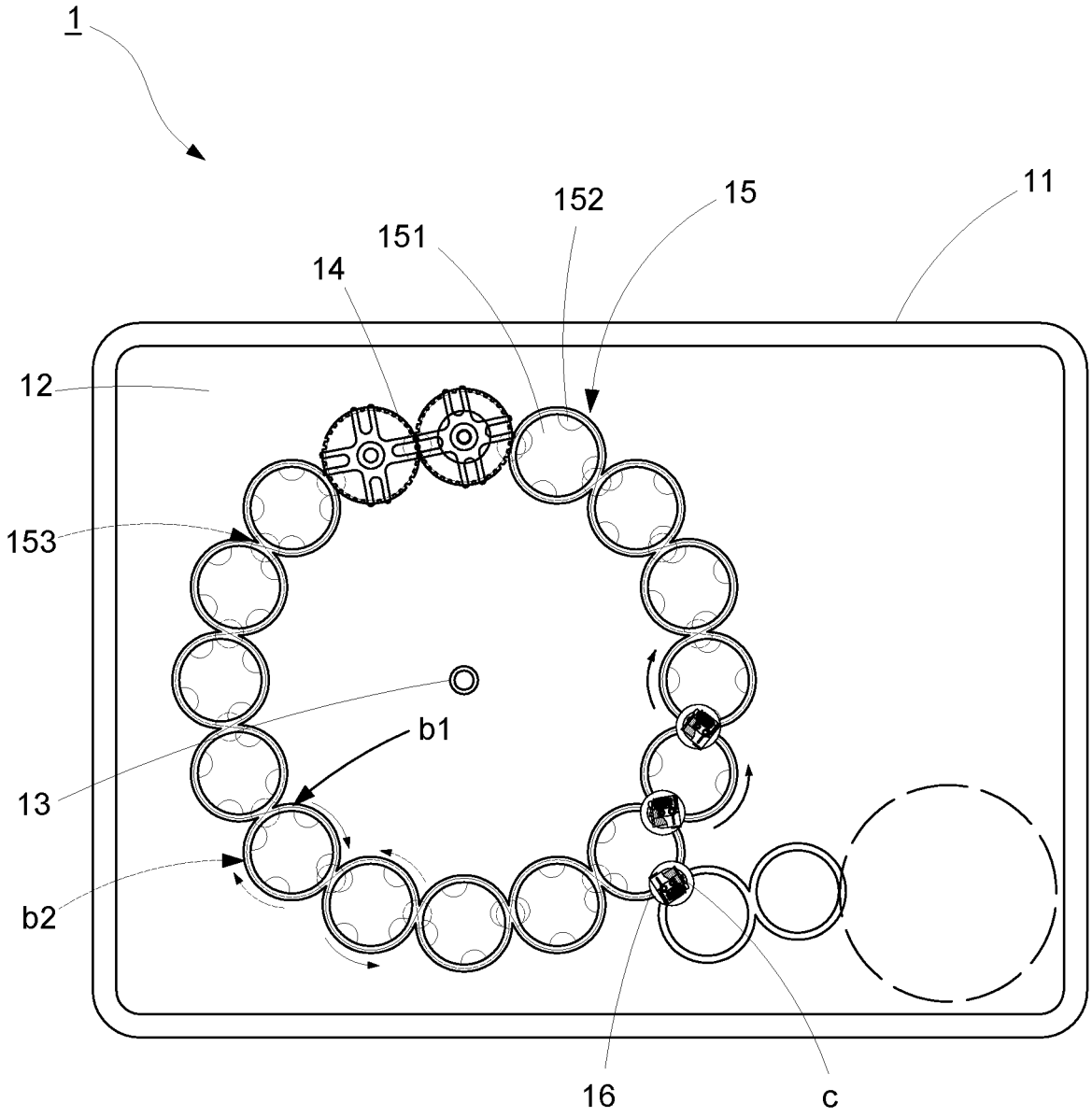
FIG. 1 (PRIOR ART)
FIG. 1 is a schematic view showing a conventional braiding apparatus.
Figure 2:
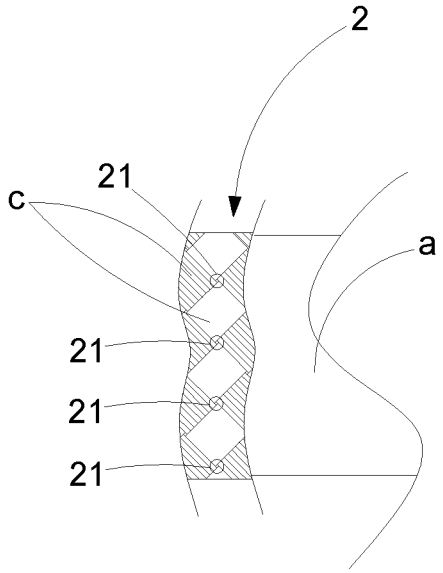
FIG. 2 (PRIOR ART)
FIG. 2 is an enlarged front view of each convolution of a conventional interwoven pattern formed by the conventional braiding apparatus.
Figure 3:
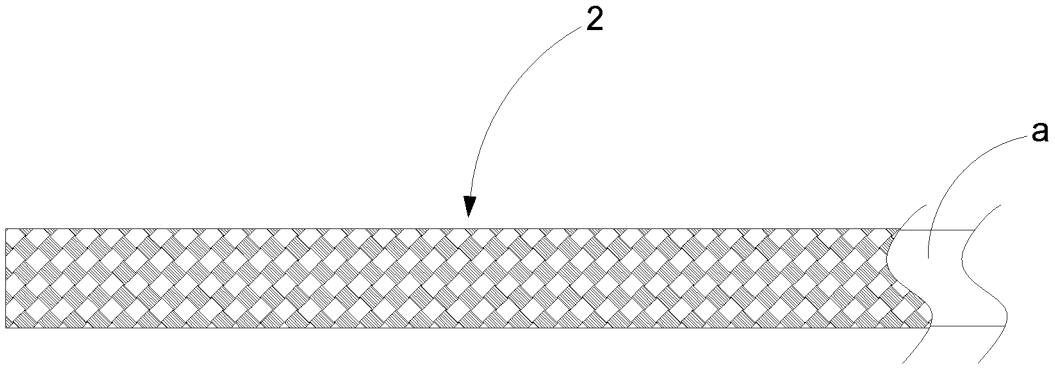
FIG. 3 (PRIOR ART)
FIG. 3 is a front view of a complete braided rope produced by the conventional braiding apparatus.
Figure 8:
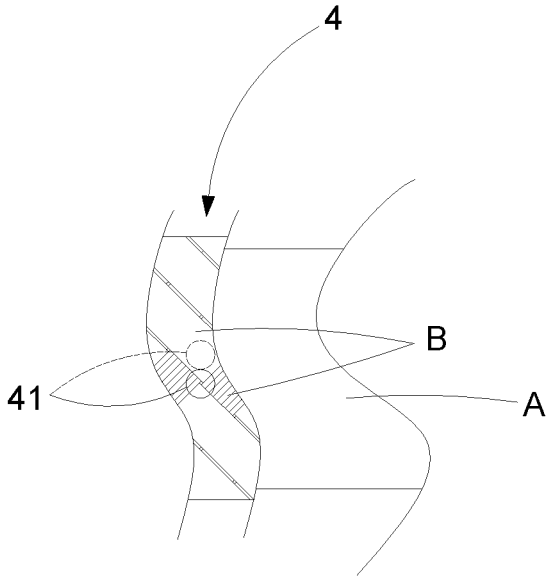
FIG. 8 is an enlarged front view of each convolution of a braided layer formed by the first preferred embodiment.

Regarding the braided layer as shown in FIGS. 8 and 9, it is apparent that the arrangement of the carrier strands "B" located on two sides of each crossing point 41 is unlike the conventional crowdedly-crossing arrangement shown in FIGS. 2 and 3, and the aforementioned two-point interwoven arrangement contributes to a broad application of the rope 4. For example, the braided layer featuring two crossing points 41 on each convolution not only increases the contact surface between the carrier strands "B" and the core strand "A" but also reduces interstices formed between the core strand "A" and the carrier strands "B", and these conditions promotes the heat conduction and facilitates an increase in the efficiency of dissipating heat while using the rope 4 in terms of heat dissipation. Therefore, this special arrangement can produce a rope 4 of good quality, and the rope 4 can be widely applied to meet practical needs, thereby increasing the practicability.

To sum up, the braiding apparatus of this invention divides the transmission discs of the track assembly which are disposed around the core unit into a first braiding track group and a second braiding track group and also takes advantage of the connection between the above transmission discs to define a first braiding route and a second braiding route on which strand carriers can shuttle respectively and incessantly for executing an incessant braiding action, especially the two braiding routes meet to form two intersections. Carrier strands fed by the strand carriers are interwoven with each other when the strand carriers pass through the two intersections. Thus, a braided layer having two crossing points on each convolution is created and wrapped around an outer surface of a core strand. Finally, the incessant braiding action of the strand carriers around the core strand produces a complete rope with the special braided layer whereby the practicability of the rope is increased.

While the embodiments are shown and described above, it is understood that further variations and modifications may be made without departing from the scope of this invention.

What is claimed is:

1. A braiding apparatus capable of generating a two-point interweaving operation, comprising:

a platform;

a base plate disposed on said platform;

a core unit disposed on said base plate and adapted to supply a core strand;

a transmission unit disposed below said base plate;

a track assembly arranged on said base plate; and a plurality of strand carriers movably mounted on said track assembly for executing an incessant shuttling motion and provided with carrier strands wound thereon;

wherein said track assembly includes a first plurality and a second plurality of transmission discs disposed on said base plate and driven by said transmission unit, each transmission disc of said first and second pluralities of transmission discs having a plurality of notches formed thereon and adapted to carry said plurality of strand carriers, and wherein said first plurality of transmission discs and said second plurality of transmission discs in said track assembly define a first braiding track group and a second braiding track group of transmission discs, respectively, said first braiding track group of transmission discs and said second braiding track group of transmission discs being arranged around said core unit in a concentric configuration, wherein said core unit defines a common center of said concentric configuration, with said first braiding track group of transmission discs encircled by said second braiding track group of transmission discs, wherein each of said transmission discs in said first braiding track group is coupled with corresponding transmission discs of said second braiding track group adjacent thereto, and wherein said transmission discs of said first braiding track group and said transmission discs of said second braiding track group are sequentially connected to each other to thereby define a first continuous braiding route and a second continuous braiding route on which said strand carriers shuttle respectively and continuously to execute said incessant shuttling motion, wherein rotating directions of said transmission discs located on said first braiding route differ from rotating directions of said transmission discs located on said second braiding route, said first braiding route and said second braiding route intersecting at two intersection points spaced apart at 180 degrees from each other, and said carrier strands thereby crossing each other when said strand carriers pass through said two intersection points, said strand carriers being actuated under said incessant shuttling motion to wrap said strand carriers around an outer surface of said core strand and interweaving said strand carriers with each other on said outer surface of said core strand, thereby forming a braided layer with a plurality of convolutions around said core strand, with each of said convolutions of said braided layer having two crossing points.

2. The braiding apparatus according to claim 1, wherein said first braiding route and said second braiding route intersect to form said two intersection points, thereby assuming a chain-like connection formed by double interlinking circuits.

* * * * *